343-909 SR
11/2/76 XR 3,990,078

United States Patent [19]
Bellee et al.
[11] 3,990,078
[45] Nov. 2, 1976

[54] IMAGE ELEMENT ANTENNA ARRAY FOR A MONOPULSE TRACKING SYSTEM FOR A MISSILE

[75] Inventors: Ernest C. Bellee; Robert C. Breithaupt; Donald L. Godwin; Scott H. Walker, all of Scottsdale, Ariz.

[73] Assignee: Motorola, Inc., Chicago, Ill.

[22] Filed: Jan. 6, 1975

[21] Appl. No.: 538,619

[52] U.S. Cl. ..... 343/770; 343/836; 343/909

[51] Int. Cl.[2] ..... H01Q 13/10; H01Q 15/00

[58] Field of Search ..... 343/754, 833, 834, 835, 343/836, 837

[56] References Cited

UNITED STATES PATENTS

| | | | |
|---|---|---|---|
| 2,840,819 | 6/1958 | McClellan | 343/834 |
| 3,774,223 | 11/1973 | Ehrenspeck | 343/837 |

*Primary Examiner*—Eli Lieberman
*Attorney, Agent, or Firm*—Harry M. Weiss; Michael D. Bingham

[57] ABSTRACT

An image element antenna array comprised of slot radiating elements is used for the antenna system for a monopulse tracking system. The image element antenna includes the radiating source disposed between two parallel reflecting planes, one of which is a total reflector and the other a partially reflecting and partially transmitting reflector. The employment of a partially reflecting plane allows for minimizing the number of radiating elements comprising a given antenna array while providing substantially the same gain and pattern activity. The antenna system may be mounted in a missile or the like for transmitting and receiving monopulse energy for steering the missile. The reduced number of radiating elements required reduces the feed network complexity and number with an attended increase in aperture efficiency.

6 Claims, 4 Drawing Figures

IMAGE ELEMENT ANTENNA ARRAY FOR A MONOPULSE TRACKING SYSTEM FOR A MISSILE

BACKGROUND OF THE INVENTION

Antenna systems of various types used with tracking systems for steering missiles or the like are well known. One type used for such purpose is the broad side antenna array system. However, the broadside antenna array requires a multitude of radiating elements and a complexity of feed networks which has the disadvantage of suffering in efficiency due to the losses associated therewith. Another significant disadvantage to the aforementioned antenna array system is the size required for the array aperture for a predetermined pattern directivity (gain).

Therefore, a need exists for an antenna system to minimize the number of radiating elements and feed network circuits in order to reduce both the size of the antenna array aperture and production costs without reducing the antenna efficiency.

SUMMARY OF THE INVENTION

Accordingly, it is an object of this invention to provide an improved antenna system for a monopulse tracking system for a missile or the like.

It is another object of this invention to provide an antenna system for minimizing the number of radiating elements comprising an antenna array while providing substantially the same or even greater gain and pattern directivity.

It is a further object of this invention to provide an antenna system employing an image element antenna suitable to be adapted to a monopulse tracking system for a missile or the like.

In a monopulse tracking system for a missile or the like wherein a given antenna array, comprising multiradiating elements, is used to provide azimuth and elevation signals to steer the missile signal, an image element antenna system is suitable for minimizing the number of radiating elements comprising the given antenna array while providing substantially the same or even greater gain and pattern directivity. The image element antenna provides a means of achieving endfire directivity from a single radiating element. The image antenna includes a radiating source between two parallel reflecting planes, one of which is a total reflector and the other a partially reflecting and partially transmitting point. The latter may be a dielectric-air interface, a dielectric plate, a short section of parallel plate wave guide or some similar arrangement. Multiple images are formed, and by superposition, substantial gain is developed using a minimum of radiating sources. Hence, a smaller antenna array aperture is needed for the guidance system.

DETAILED DESCRIPTION OF THE PREFERRED EMBODIMENT

Figure 1:
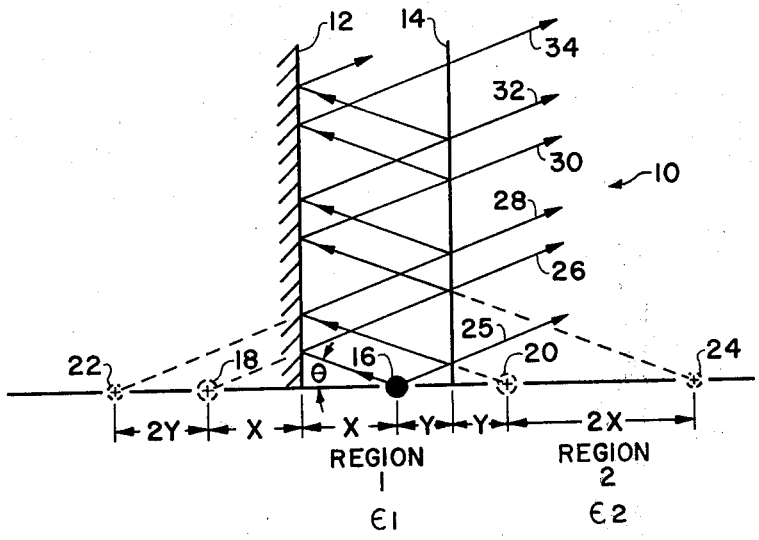
FIG. 1 is a diagram of an image element antenna of one embodiment of the invention.
Figure 2:
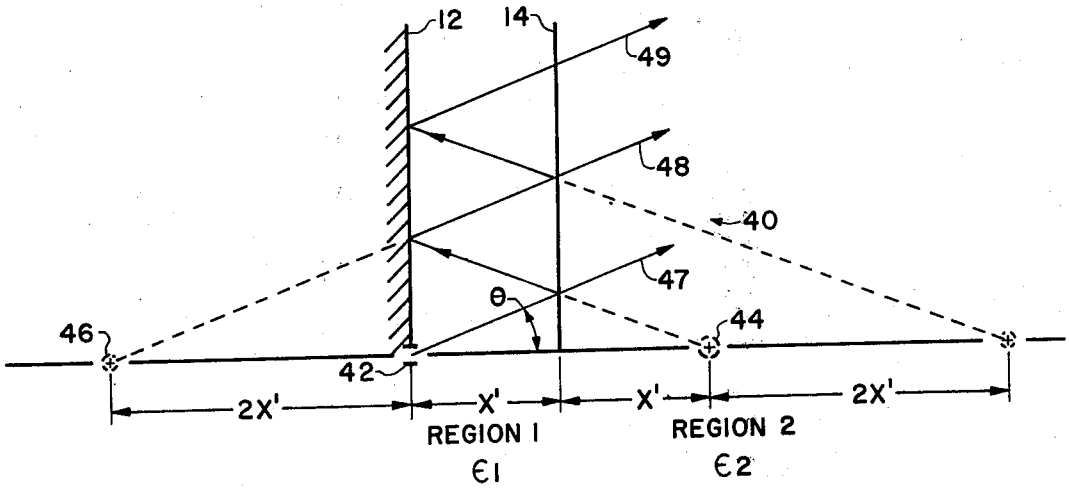
FIG. 2 is a diagram of an image element antenna of another embodiment of the invention.

Referring to FIG. 1 and FIG. 2 there are illustrated two image element antenna systems of the preferred embodiments. The image element antenna concept consists of a radiating source between two parallel reflecting planes, one of which is a total reflector and the other a partial reflecting surface, as is known in the art.

A detailed discussion of image element antennas is presented in a paper entitled "Partially Reflecting Sheet Arrays", IRE Transactions on Antennas and Propagation, October 1956, pages 666–671. Therefore, only a brief discussion of the particular image element antenna systems of the embodiment of the present invention is attempted hereinafter.

More particularly, FIG. 1 illustrates an image element antenna 10 of one embodiment which is illustrated to include a total reflecting plane 12 and a partially reflecting and partially transmitting plane 14. Total reflecting plane 12 may be a plane, conducting sheet as, for example, a metal plate. Partially reflecting and partially transmitting plane 14 is made of any suitable dielectric material, the choice depending substantially on the frequency at which antenna 10 is to be operated. Spaced between the two parallel planes is a radiating source 16 which is at a distance X from reflector surface 12 and at a distance Y from partial reflector 14.

It is well known in the art that an increase in gain and in directivity of an antenna can be obtained by the use of a total reflecting surface for producing image enhancement.

An even greater increase in directivity and, therefore, in gain can be obtained by adding partially reflecting and transmitting reflector 14 in front of source 16 and parallel to reflector 12, causing multiple reflections or images. The distances at which the images (18,20,22, and 24) would "seem" to be radiating energy are illustrated in FIG. 1 as 2X, 2Y, 2Y + 2X, and 2X + 2Y, respectively.

The source radiation and multiple source reflections between reflector 12 and reflector 14 result in energy radiation, as shown, by rays (25,26,28,30,32 and 34). The expression for the radiation field is derived from the geometric expression as follows:

$$E = \lim_{n>\infty} \tau E_0[(1-A) - \rho AB(1-A) + (\rho AB)^2(1-A) - (\rho AB)^3(1-A) + ] \quad (1)$$

$$E = \lim_{n>\infty} \tau E_0[(1-A)(1-\rho AB + (\rho AB)^2 + (\rho AB)^n] \quad (2)$$

$$E = \frac{\tau E_0(1-A)}{1+\rho AB} \quad (3)$$

where:

$\rho$ = reflection coefficient $\tau$ = transmission coefficient $A = e^{-j2\pi/\lambda\,(2X)\cos\phi}$ $B = e^{-j2\pi/\lambda\,(2Y)\cos\phi}$ Thus, the geometric expression results in a simple geometric series, equation 3, whose constants are defined above. By way of example, the amplitude of the energy of each of the rays (25,26,28,30,32 and 34) can be expressed as:

$E_{25} = \tau E_0$ $E_{26} = -\tau E_0 A$ $E_{28} = -\tau E_0 A B \rho$ $E_{30} = \tau E_0 A^2 B \rho$ $E_{32} = \tau E_0 A^2 B^2 \rho^2$ $E_{34} = -\tau E_0 A^3 B^2 \rho^2$ If it is assumed that a broadside antenna array is to be used ($\phi$=0) and by setting the distances $x$ and $y$ of FIG. 1 to equal $\lambda/4$ and $\lambda/2$, respectively, equation 3 is reduced to:

$$E = \frac{2\tau E_0}{1-\rho} \tag{4}$$

Since, $\tau = 1 + \rho$, equation (4) may be expressed as:

$$E = \frac{2E_0(1+\rho)}{(1-\rho)} \tag{5}$$

Thus, equation (5) requires that $\rho$ have a positive value so so that antenna gain can be realized. For example, in the theoretical lossless case, when $\rho = .6$;

$$E = \frac{3.2\,E_0}{.4} = 8E_0$$

which is a gain of approximately 18dB.

A positive reflection coefficient is obtained by making the dielectric constant, $\epsilon$, of region 1 (the dielectric property of partially reflecting and transmitting plane 14) greater than that of region 2 ($\epsilon_1 > \epsilon_2$), or by the use of a below cut-off parallel plate transmission line section which provides a positive imaginary reflection coefficient.

FIG. 2 illustrates an image element antenna 40 which has a slot 42 for the source of radiation. Slot 42 is located in the plane of reflector 12. Again, as before, the radiation field can be expressed by a geometric expression:

$$E = \lim \tau E_0[1 - B\rho + (B\rho)^2 - (B\rho)^3 + \ldots + (B\rho)^{\eta}] \tag{6}$$

and simplified to:

$$E = \frac{\tau E_0}{(1+\rho B)}$$

where:

$\tau$ = transmission coefficient $\rho$ = reflection coefficient $B = C^{-j2\pi/\lambda\,(x')\cos\theta}$ As is the case for antenna 10, multiple reflections are developed in antenna 40 which "appear" as image sources 44 and 46. Therefore, improved gain and directivity are realized by image element antenna 40.

By setting the spacing $x' = \lambda/4$ and substituting $(1+\rho)$ for $\tau$, equation 6 reduces to:

$$E = \frac{E_0(1+\rho)}{(1-\rho)} \tag{7}$$

resulting in gain for positive values of $\rho$. Again, as for image antenna 10, if $\rho$=0.6;

$$E = \frac{1.65}{.4} = 4E_0$$

or again of 12 dB.

The gain of image element antenna 40 is 6 dB less than the gain of image element antenna 10. This is due to the loss of the direct image of the source.

Moreover, if a plurality of source elements were to be combined in the structure, as described above, such that their radiation fields are added, an antenna system having much greater directivity and, therefore, gain can be realized with less source elements for a given array aperture than conventional broad side antenna arrays.

In some conventional monopulse guidance systems, broad side antenna arrays are used as the antenna system for the guidance portion of a missile or the like. By using comparators, well known in the art, sum channel signal information, and two difference channels signal information are developed for guiding the missile. The two difference channels are used to provide azimuth and elevation direction information for the guidance system.

However, to obtain maximum gain in directivity, the aforementioned broad side antenna arrays have needed a multitude of radiating elements. Hence, the antenna arrays have been quite large in their array aperture and required multiple and complex feed networks feeding the radiating elements.

Moreover, because multiple feed networks are required, the overall antenna efficiency is reduced because of the transmission losses associated with the feed networks.

By using the image element antenna as illustrated in FIG. 2 the number of radiating elements required is greatly reduced while providing a suitable antenna system having greatly thinned arrays. In one typical application an allowable array thinning by a factor of 10 to 1 was obtained resulting in higher efficiency due to less loss in the distribution network. In addition, the thinning of the array radiating elements results in lower production costs.

Figure 3:
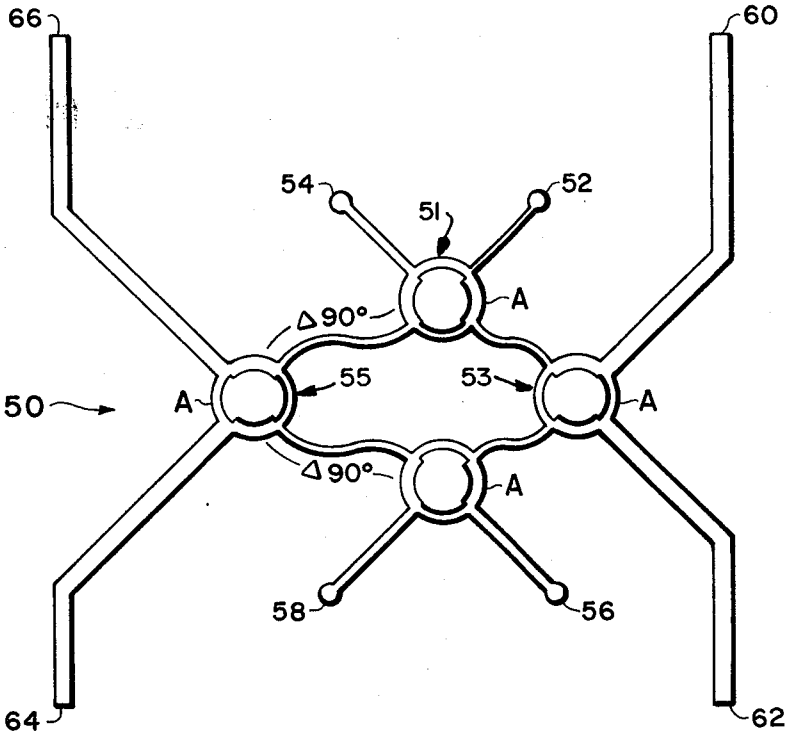
FIG. 3 is an enlarged diagram of the singular feed network circuit used to drive the image element antenna system of the preferred embodiment of the invention.
Figure 4:
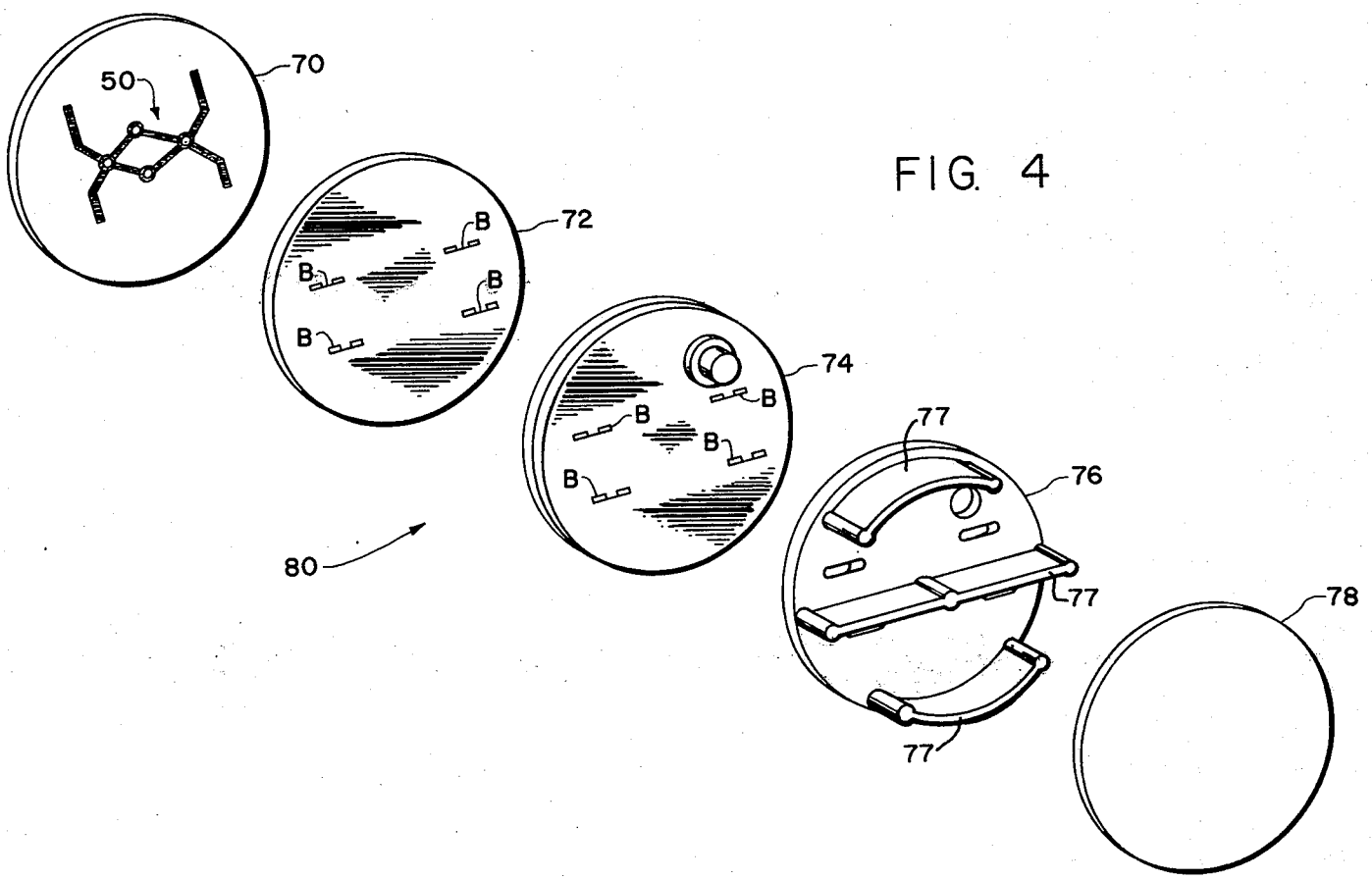
FIG. 4 is an exploded view of the antenna system of the preferred embodiment of the invention.

Referring to FIGS. 3 and 4 there is shown an antenna system for a missile or like comprising image element antenna 40 of FIG. 2, wherein four slot sources are used for radiating electromagnetic energy.

As illustrated in FIG. 3, a single feed network 50 is shown. Feed network 50 is comprised of four hybrid branch lines (A) which are connected in such a manner that is well known in the art to provide energy to slot sources (B) of FIG. 4 of the correct phase at the respective output terminals 60,62,64, and 66.

Referring to FIG. 4, there is shown an exploded view of the image element antenna system including feed network 50. Feed network 50 is fabricated using conventional strip line techniques; with feed network circuit board 70 being teflon fiberglass material. Slot source board 72, also of copper clad teflon fiberglass, is shown to comprise the four slot sources (B) and which is mated to feed network board 70 with the alignment of output terminals 60,62,64, and 66, of feed network 50, being in line with the slot sources (B). Board 74 illustrates the aforementioned mating of boards 70 and 72.

Board 74 is then aligned and fixed to reflector 76 which provides the total reflecting surface of image element antenna 40. Dielectric plate 78 being of suitable dielectric material and corresponding to partially reflecting and transmitting plane 14 (FIG. 2) is then attached to reflector board 76 completing the image element antenna. Dielectric plate 78 is spaced from reflector 76 appropriately, as discussed earlier in regards to antenna 40 of FIG. 2, by spacer flanges 77. Thus, antenna array 80 comprises four individual image element antennae 40 spaced in quadrature relationship.

In a monopulse radar transceiver the transmitted signal information is applied to input terminal 52 of feed network 50 (FIG. 3) and transmitted by image element antenna array 80. The operation of feed network or comparator circuit 50 to provide the above function is generally known in the art and need not be discussed in great detail. However, in a conventional manner, the transmit signal applied to input terminal 52 of hybrid branch line 51 is divided, appearing at the output ports of branch line 51. The signals at the output ports (terminal 54 being ideally the isolated port) are in phase quadrature. The signal appearing at the output port of branch 51 which is supplied to branch line 55 has an additional phase shift of 90° effected thereto such that the phase of both signals from branch line 51 to the input ports of branch lines 53 and 55, respectively, are substantially the same. With signals of equal phase supplied thereto, the phase of each signal obtained at output terminal 62 and 64 are substantially identical to one another. The signals appearing at the other output ports of branch lines 53 and 54 (which are transmitted to output terminals 60 and 66 respectively) are also of the same phase with respect to each other but in phase quadrature to the signals appearing at outputs terminal 62 and 64 of feed network or comparator network 50. Moreover, an additional phase shift of 90° is introduced between output terminal 60 and 66 such that the latter signals appearing thereat are 180° out of phase with the signals appearing respectively at output terminals 62 and 64. However, as is understood, because the slot sources B which are mated to output terminal 60 and 66 radiate energy 180° out of phase to the energy radiated from the slot sources B which are mated to output terminals 62 and 64 all four signals radiated are of the same phase. Thus the energy radiated will be a wave front having a uniform phase.

The operation of comparator of feed network 50 for producing difference channel information can be briefly explained in a similar manner. For example, if a signal is supplied to input terminal 54, the signals appearing at the output ports of branch line 54 are again in phase quadrature (terminal 52 now being the isolated port). However, the additional 90° phase shift introduced to the signal supplied to branch line 55 causes the signal thereat to be 180° out of phase with the signal supplied to the input of branch line 53. Thus, the signals appearing at output terminals 62 and 64 are 180° out of phase with respect to each other. Also, remembering the additional 90° of phase shift introduced therebetween and the differential 180° due to the particular manner in which the slot sources B are fed, the signal radiated from slot source B mated to output terminal 66 will be in phase with the radiated signal from terminal 64. Likewise, the energy radiated from the slot sources, B, mated to terminals 60 and 62, respectively, are in phase. Thus, for example, azimuth tracking information is obtained from port 54. In a like manner, the signal information appearing at terminal 56 will be indicative of the other difference channel information, as for example, elevation information. Therefore, the monopulse received signal information is received by image element antenna array 80 with the sum channel information being developed at terminal 52 of feed network 50 and the two difference channel information signals being developed at terminals 54 and 56 respectively. Terminal 58 of feed network 50 is not required for developing the azimuth and elevation channel information and is therefore terminated in an internal load.

Image element antenna system 80 is adaptable to any standard guidance system for missiles or the like. As has been described, only a single feed network is required for the antenna system which greatly increases the antenna efficiency.

The above described antenna system is simple and inexpensive. It has several advantages over the conventional antenna arrays used in monopulse guidance systems. These advantages include a reduction on the order of 10 to 1 in a number of radiating elements required for a given array aperture, and a significant improvement in antenna efficiency because of a greatly simplified feed network. Also, a significant reduction in physical size for the same gain factor.

The foregoing description of the embodiment of the invention is one example and not intended to limit the scope of the intended claims. No attempt has been made to illustrate all possible embodiments of the invention, but rather only to illustrate its principles in the best manner presently known to practice it. Therefore, such other forms of the invention that may occur to one skilled in the art upon reading of the foregoing specification are also within the spirit and scope of the invention, and it is intended that this invention includes all modification and equivalents which fall within the scope of the appended claims.

What is claimed is:

1. In a monopulse tracking system for a missile or the like including an antenna array for transmitting and receiving signals indicative of the sum, azimuth and elevation signal information, the improvement comprising:

image element antenna means for minimizing the number of energy radiant sources of the antenna array for a given array aperture while providing substantially the same or greater gain and pattern directivity including at least four energy radiant sources in quadrature spaced relationship to each other and having a total reflecting surface, and a partially transmitting and reflecting surface whereby energy from said radiant energy sources is both reflected from and transmitted therethrough, said partially transmitting and reflecting surface being spaced substantially parallel to said total reflecting surface by a predetermined distance; and feed means coupled to said image element antenna means for coupling said signal to be transmitted to each of said energy radiant sources such that the signal to be transmitted is radiated from said image element antenna everywhere uniform in phase and said feed means having a plurality of outputs at which respectively is produced the sum, azimuth and elevation channel information in response to signals being received by said image element antenna means.

2. The antenna in accordance with claim 1 wherein said image antenna means includes:

said energy radiant sources being spaced between said total reflecting surface and said partially transmitting and reflecting surface; and said partially transmitting and reflecting surface being of a suitable dielectric material thereby effecting a dielectric-to-air interface.

3. The antenna in accordance with claim 1 wherein said energy radiant sources include slot source means for radiating electromagnetic energy, said slot source means being located in the plane of said total reflecting surface.

4. The antenna in accordance with claim 3 wherein said partially transmitting and reflecting surface is spaced approximately one-half wavelength above said slot source means.

5. A partially reflecting antenna system for use in a monopulse guidance system for a missile or the like, comprising:

a plurality of slot source means for radiating or receiving monopulse electro-magnetic energy;

reflecting means for totally reflecting said electromagnetic energy from said slot source means;

said slot source means being in the same plane of said reflecting means;

partially transmitting and reflecting means spaced from and substantially parallel to said slot source means for partially reflecting and transmitting said electromagnetic energy which is radiated by said slot source means and;

feed means for supplying energy of the correct phase to said slot source means to be transmitted thereby, said feed means providing in response to signal information received by said slot source means sum, azimuth and elevation channel information at respective outputs thereof.

6. The antenna system of claim 5 wherein the number of slot source means is a minimum of four and said slot source means are quadraturally spaced in the antenna system.

* * * * *